US007585127B2

(12) United States Patent
Mudryk et al.

(10) Patent No.: US 7,585,127 B2
(45) Date of Patent: Sep. 8, 2009

(54) ROADSIDE POST

(75) Inventors: Boydan Joseph Mudryk, New South Wales (AU); Garry David Campbell, New South Wales (AU)

(73) Assignee: Delnorth Pty. Ltd., New South Wales (AU)

( * ) Notice: Subject to any disclaimer, the term of this patent is extended or adjusted under 35 U.S.C. 154(b) by 0 days.

(21) Appl. No.: 10/561,123

(22) PCT Filed: Jun. 10, 2004

(86) PCT No.: PCT/AU2004/000772

§ 371 (c)(1),
(2), (4) Date: Oct. 19, 2006

(87) PCT Pub. No.: WO2004/113619

PCT Pub. Date: Dec. 29, 2004

(65) Prior Publication Data

US 2007/0053744 A1 Mar. 8, 2007

(51) Int. Cl.
*E01F 9/00* (2006.01)
*E01F 9/011* (2006.01)
*E01F 9/017* (2006.01)

(52) U.S. Cl. ..... 404/10; 404/9

(58) Field of Classification Search ..... 404/6, 404/10; 116/63
See application file for complete search history.

(56) References Cited

U.S. PATENT DOCUMENTS

| | | | | | |
|---|---|---|---|---|---|
| 2,155,349 | A * | 4/1939 | Mathesius et al. | 420/100 |
| 2,646,969 | A * | 7/1953 | Hendrickson | 256/13.1 |
| 3,362,305 | A * | 1/1968 | Pellowski | 404/10 |
| 3,858,997 | A * | 1/1975 | Boone | 404/10 |
| 3,875,720 | A * | 4/1975 | Russell | 52/736.3 |
| 4,061,435 | A * | 12/1977 | Schmanski et al. | 404/10 |
| 4,092,081 | A | 5/1978 | Schmanski | |
| 4,126,403 | A | 11/1978 | Sweeney et al. | |
| 4,298,292 | A | 11/1981 | Sweeney | 404/10 |
| 4,486,117 | A | 12/1984 | Blau | 404/10 |
| 4,522,530 | A | 6/1985 | Arthur | |
| RE32,045 | E * | 12/1985 | Schmanski | 404/10 |
| 5,238,322 | A * | 8/1993 | Stirtz | 404/10 |
| 5,957,425 | A * | 9/1999 | Conway et al. | 248/548 |
| 6,267,529 | B1 * | 7/2001 | Mudryk et al. | 404/10 |
| 6,375,385 | B1 | 4/2002 | Kennedy | |
| 7,186,054 | B2 * | 3/2007 | Chambers | 404/9 |
| 7,473,051 | B2 * | 1/2009 | Audet | 404/10 |
| 2005/0196235 | A1 * | 9/2005 | Strick | 404/10 |

FOREIGN PATENT DOCUMENTS

| | | |
|---|---|---|
| AU | 198281180 | 9/1982 |

(Continued)

*Primary Examiner*—Raymond W Addie
(74) *Attorney, Agent, or Firm*—Wood, Herron & Evans, L.L.P.

(57) ABSTRACT

A roadside post (10, 110) comprises an elongate body (30, 130) formed of sheet spring steel. The body (30, 130) has a longitudinal axis (L), a front face (31, 131) and a rear face (33, 133). The body (30, 130) is elastically bendable through 90' from an unbent state about a transverse axis (T) transverse to the longitudinal axis (L). The front and rear faces (31, 131, 33, 133) transversely extend generally parallel to the transverse axis (T). The roadside post (10) may further comprise a rigid base (20).

37 Claims, 4 Drawing Sheets

FOREIGN PATENT DOCUMENTS

| | | |
|---|---|---|
| AU | 199665536 | 3/1997 |
| DE | 19654203 | 6/1998 |
| DE | 19843532 A1 | 3/2000 |
| EP | 0335591 | 10/1989 |
| GB | 2183698 A | 6/1987 |

* cited by examiner

ROADSIDE POST

FIELD OF THE INVENTION

The invention relates to roadside posts for supporting signage or delineating paths, roadways or boundaries.

BACKGROUND OF THE INVENTION

Common examples of roadside posts include sign posts and guide posts, which are usually located on the edge or shoulder of roadways to delineate lanes and direct traffic. Guide posts are particularly effective when visibility is impaired, such as at night on unlit highways. Retro-flective sheeting is commonly used on delineator guide posts in various grades to reflect light and indicate to motor vehicle drivers the varying contours and directions of the approaching section of road.

Roadside posts are often impacted and damaged by wayward vehicles and must be replaced or repaired. Timber posts will commonly fracture when impacted and must be replaced. Existing plastic or plastic/rubber composite posts are flexible and resilient enabling them to recover after impact. However, plastic or rubber posts tend to deteriorate due to UV exposure and repeated impacts over time. Steel posts have also been employed and are generally not resilient, plastically deforming upon impact and must be manually restraightened. Some known devices also employ a hinging mechanism between two or more rigid members. The hinging mechanism is typically a flexibly resilient rubber or plastic material. The rubber or plastic components of these posts also deteriorate due to UV exposure and repeated impacts. Other hinging mechanisms are either not resilient or complicated and expensive to manufacture.

Often the nature of the vehicle impact is a direct wheel-over in which the vehicle wheel rolls directly over the post pressing it flat against the surface of the ground. Known posts are installed in the ground to bend only above the surface of the ground and are therefore, not adapted to bend flat against the ground surface without enduring a tight right angle bend at the surface. During a direct wheel-over, flexible posts are forced to bend substantially at a tight right angle at the ground surface. Subsequently, during a direct wheel-over, crease points can occur in the post at the surface of the ground as the post is forced into a tight right angle bend. Tight right angle bends accelerate fatigue of the post and also increase plastic deformation in metal posts.

OBJECT OF THE INVENTION

It is the object of the present invention to substantially overcome or at least ameliorate one or more of the disadvantages of the prior art.

SUMMARY OF THE INVENTION

Accordingly, in a first aspect, the present invention provides a roadside post comprising an elongate body formed of sheet spring steel and having a longitudinal axis, a front face and a rear face, wherein:

said body is elastically bendable through 90 degrees from an unbent state about a transverse axis transverse to said longitudinal axis, said front and rear faces transversely extending generally parallel to said transverse axis.

Preferably, said body is elastically bendable through 90° from said unbent state about said transverse axis to either side of said longitudinal axis.

Preferably, said body is formed from sheet spring steel having a Rockwell hardness of C40 to C47. Further preferably, said spring steel is high carbon steel C1075.

Preferably, said body has a width of approximately 75 mm to 120 mm. The sheet spring steel may have a thickness of approximately 0.9 mm to 1.5 mm.

Desirably, said body has a substantially arcuate transverse cross-section. Preferably said arcuate transverse cross-section has a radius of approximately 100 mm to 250 mm. Alternatively, said transverse cross section is a channel cross-section comprising a central web and two lateral flanges. Preferably, the angle formed between said web and each said flange is approximately 150° to 175°: Preferably, the web has a width of approximately 30 mm to 60 mm.

In a preferred embodiment, the post body is formed with longitudinal extending ribs. The apex of each of the ribs is preferably separated by approximately 5 mm to 25 mm and the ribs preferably protrude approximately 0.2 mm to 0.8 mm from the trough between each rib.

In one form, said post further comprises a rigid base adapted to be driven into the ground, a first end of said body being fixed to said base.

Preferably, the base has a tapered end longitudinally distal of the body, said base tapered end being adapted to be driven into the ground. Further preferably, said base is formed of steel.

In another form, a first end of said body is adapted to be driven into the ground.

Typically, said body first end is tapered.

Preferably, the body includes a mark indicative of the location of the surface of the ground when said post is driven into the ground to a design depth.

Further preferably, said mark is a hole. Desirably, said mark is located approximately 50 mm to 150 mm longitudinally distal of said base.

In a second aspect, the present invention provides a roadside post installation comprising said roadside post of the first aspect in which said post is driven into the ground.

Typically, a recess is formed in the ground immediately adjacent said body to allow uninhibited bending of said body, said recess extending across either of said front face and said rear face.

Preferably, two said recesses are formed in the ground, a first said recess extending across said front face and a second said recess extending across said rear face.

Preferably, the entire said base is located beneath the surface of the ground.

Desirably, the top of said base is located at a depth of approximately 50 mm to 150 mm beneath the surface of the ground.

Further desirably, said recess extends approximately 50 mm to 150 mm from said transverse axis at the surface of the ground.

The recess may have a depth of approximately 50 mm to 150 mm.

In a third aspect, the present invention provides a method of installing the roadside post of the first aspect in the ground, said method comprising driving said post into the ground.

Preferably the method further comprises forming a recess in the ground immediately adjacent said body to allow uninhibited bending of said body, said recess extending across either of said front face and said rear face.

BRIEF DESCRIPTION OF THE DRAWINGS

Preferred embodiments of the invention will now be described with reference to the accompanying drawings wherein.

DESCRIPTION OF THE PREFERRED EMBODIMENTS

Figure 1:
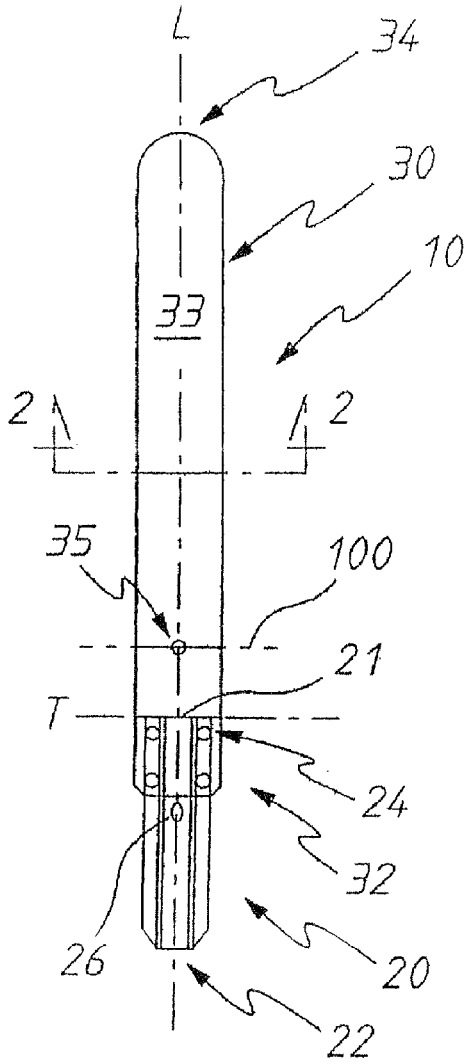
FIG. 1 is a rear elevation view of a post in an unbent state.
Figure 2A:
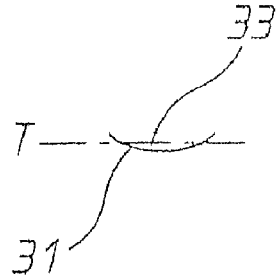
FIG. 2*a* is a cross sectional view taken along the line 2-2 of a first embodiment of the post of FIG. 1.
Figure 2B:
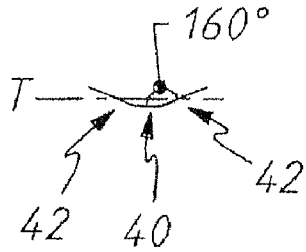
FIG. 2*b* is a cross sectional view taken along the line 2-2 of a second embodiment of the post of FIG. 1.
Figure 3:
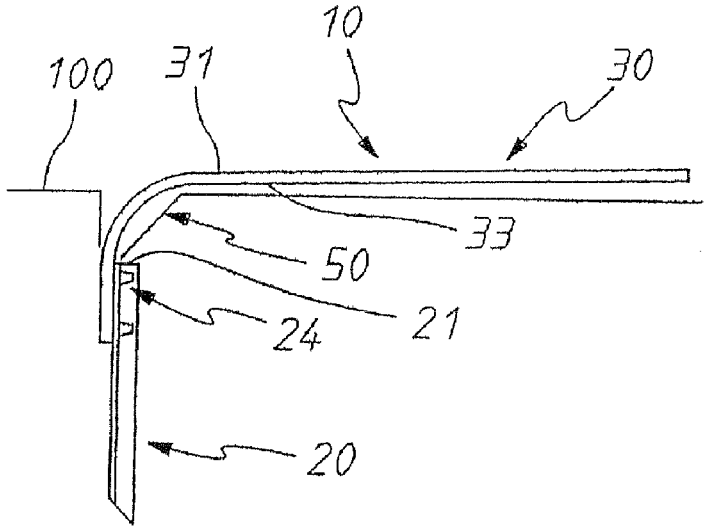
FIG. 3 is a side elevation view of a post installation with the post of FIG. 1 in a bent state.

FIGS. 1 to 3 depict a roadside post 10. The post 10 comprises a base 20 and an elongate body 30 having a longitudinal axis L. The body 30 is 1188 mm in length and the base 20 is 250 mm in length. A first end 32 of the body 30 is fixed to the base 20. The second end 34 is rounded for safety. The base 20 has a tapered end 22 longitudinally distal of the body 30. The body 30 is formed from sheet spring steel, preferably having a Rockwell hardness of C40 to C47. The spring steel may be high carbon steel C1075. The body 30 has a front face 31 and a rear face 33. The body 30 is elastically bendable through 90° about a transverse axis T transverse to the longitudinal axis L of the body 30. The body front and rear faces 31, 33 extend generally parallel to the transverse axis T.

FIG. 1 is a rear elevation view of the post 10 in an unbent state, in which the body 30 extends longitudinally. The post 10 is installed by driving the base 20 longitudinally into the ground 100 so that the body 30 projects vertically from the ground 100, typically with the entire base 20 located beneath the surface of the ground 100. The top 21 of the base 20 is preferably located at a depth of approximately 100 mm beneath the surface of the ground 100 when installed to the design depth. When installed to the design depth the body 30 projects 1000 mm above the surface of the ground. A depth marker hole 35 is provided on the body 30, 100 mm from the top of the base, and is indicative of the ground surface level when installed to the design depth. The post 10 is accordingly driven into the ground 100 until the hole 35 is aligned with the surface of the ground 100.

The base 20 is generally channel shaped in transverse cross section and is fixed to the first end 32 by means of four impact resistant pins and collars 24. The base 20 is also provided with a removal slot 26 to facilitate removal of the post 10 from the ground by inserting a hook through the slot 26 and pulling upwards. The removals slot may alternatively be located on the body 30.

FIG. 2*a* shows a preferred embodiment of the body 30 in which the transverse cross section of the body 30 taken at 2-2 is arcuate having a radius of approximately 250 mm and a transverse width of approximately 100 mm. The sheet spring steel from which the body 30 is formed has a thickness of 1.2 mm. The arcuate cross section increases the stiffness of the body 30 in the unbent state, so as to inhibit bending of the body 30 under wind loads, including those generated by vehicles driving by, and biases the body 30 to the unbent state.

FIG. 2*b* shows an alternative embodiment of the body 30 having a channel transverse cross section taken at 2-2 comprising a central web 40 and two lateral flanges 42, each defining an angle of approximately 160° with the web 40. The transverse width and sheet thickness are the same as the embodiment of FIG. 2*a* and the width of the web 40 is 50 mm. This channel cross section exhibits similar stiffness and biasing qualities to the arcuate cross section of FIG. 2*a*.

FIG. 3 is a side view of the post of FIG. 1 in a rearwardly bent state, for example, when impacted from front on by a vehicle in a direct wheel-over. When installed in the ground 100, a recess 50 is formed in the ground above the base 20 and immediately behind the body 30 to allow uninhibited bending of the body 30. The recess 50 may be formed by removing a portion of the ground and extends across the body rear face 33. The recess 50 is typically at least 100 mm deep and extends at least 100 mm rearwardly of the transverse axis T of the body 30 at the ground surface. This allows a bend radius of 100 mm for the body 30 compared with a bend radius of near zero for tight right angled bends that occur in prior art post installations. This assists in enabling elastic bending of the body 30 and reduces fatigue, while allowing the body 30 to lie substantially prostrate on the surface of the ground 100 as the vehicle wheel rolls over the body 30. This minimises damage to the wheel, vehicle and post 10. The recess 50 may be filled with sand or another loose or compressible material without significantly affecting the bend radius of the lower portion 36.

After impact, the resilience of the spring steel and the bias of the cross section urge the body 30 to return to the undeformed state shown in FIG. 1.

Figure 4:
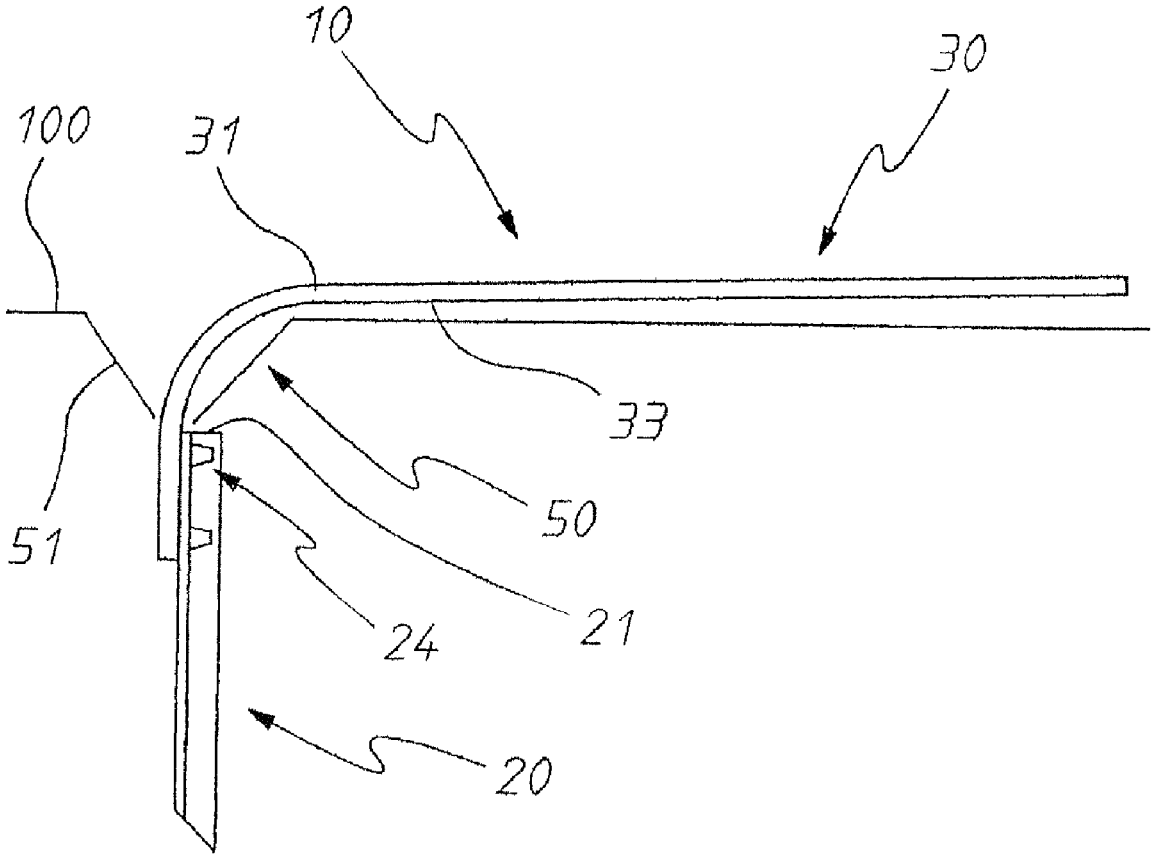
FIG. 4 is a side elevation view of an alternative post installation with the post of FIG. 1 in a bent state.
Figure 6:
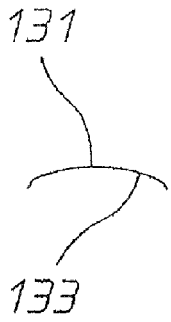
FIG. 6 is a plan view of the post of FIG. 5.
Figure 5:
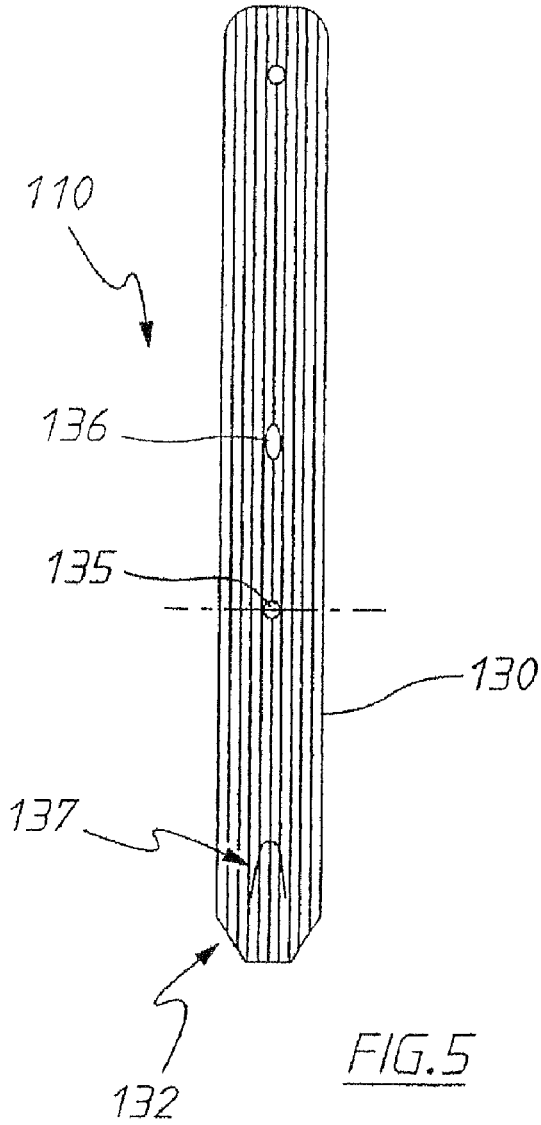
FIG. 5 is a front elevation view of an alternate post in an unbent state.
Figure 7:
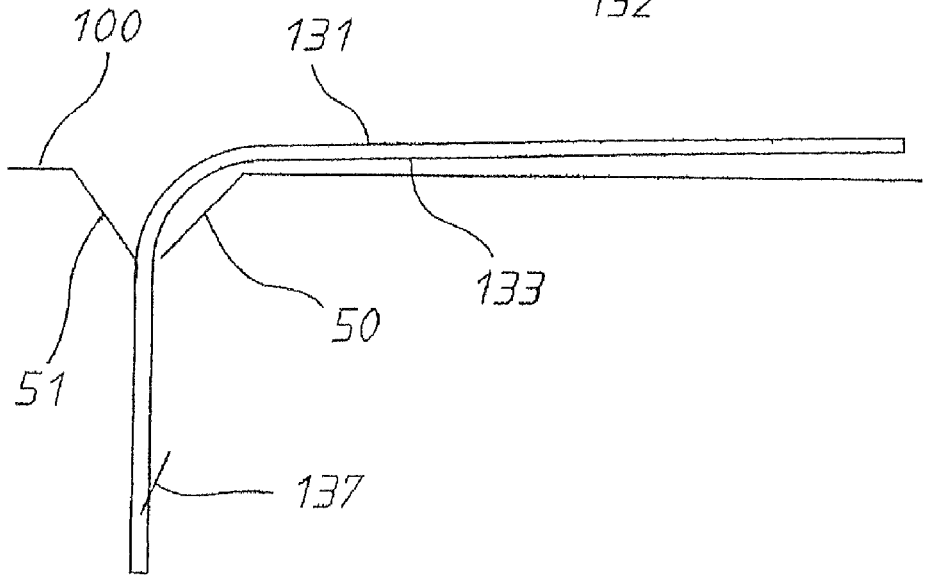
FIG. 7 is a side elevation view of a post installation with the post of FIG. 5 in a bent state.

The body 30 is able to bend through 90° from the vertical when impacted either from the front or the rear, bending about the transverse axis T to either side of the longitudinal axis L. To allow uninhibited bending of the body 30 when impacted from the rear, a further recess 51 may be formed in the ground above the base 20 immediately forward of the body 30, and extending across the body front face 31 as depicted in FIG. 4.

The post 10 is powder coated to prevent corrosion.

FIGS. 5 to 10 depict an alternate road side post 110 comprising a body 130 without a separate base. The first end 132 of the body 130 is adapted to be driven into the ground 100. To facilitate driving of the body first end 132 into the ground, the body first end 132 is tapered. A ground retention barb 137 is formed in the body 130 toward the body first end 132 to assist in retaining the body first end 132 within the ground 100. The ground retention barb 137 is integrally formed with the body 130, being punched from the spring sheet steel. The ground retention barb 137 extends towards the body second end 134. A depth marker hole 135 and removal slot 136 are formed in the post body in the same manner as described above in relation to the post 10 of FIGS. 1 to 3.

Recesses 50, 51 are again formed in the ground adjacent the body front and rear faces 131, 133 to allow uninhibited bending of the body 130 at ground level, providing for a generous bend radius when the body 130 is bent upon impact.

Figure 9:
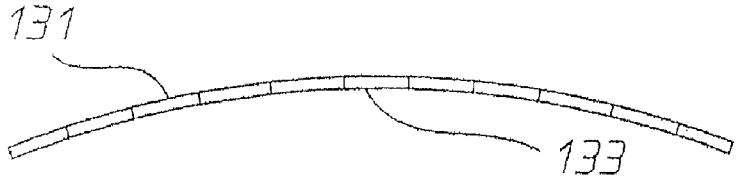
FIG. 9 is an enlarged plan view of the profile of the post of FIG. 5.
Figure 10:
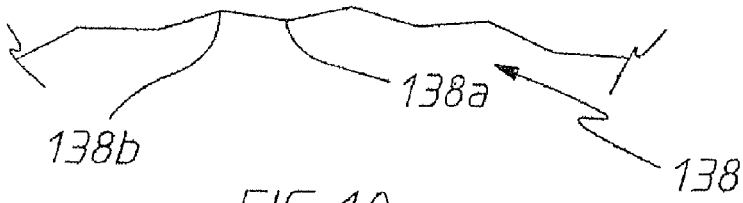
FIG. 10 is an exploded detail view of the profile of FIG. 9.
Figure 8:
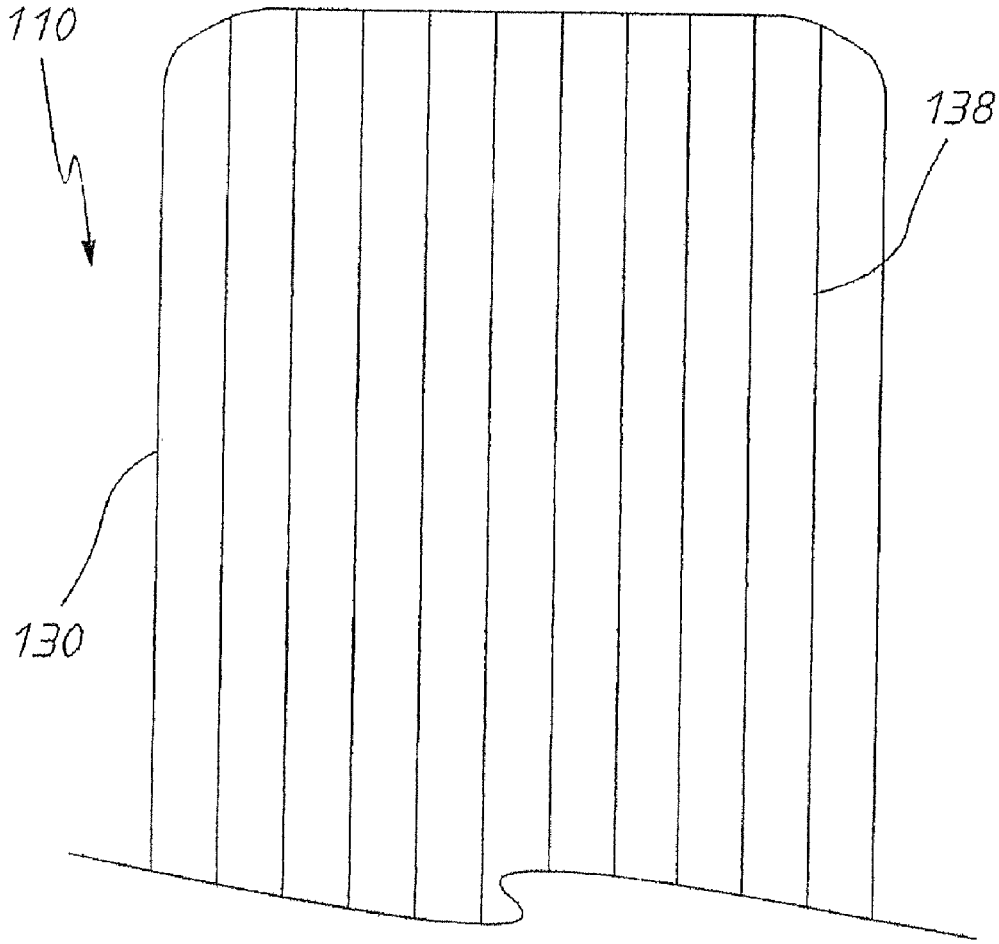
FIG. 8 is an enlarged partial front elevation view of the post of FIG. 5.

Referring specifically to FIGS. 8 through 10, the profile of the post body 130 may be formed with longitudinally extending ribs 138, pressed into the sheet spring steel, to form a very slight concertina type profile on the body front and rear faces 131, 133. The apex 138*a* of each of the ribs 138 may be separated by approximately 10 mm, and protrude by approximately 0.3 mm from the trough 138*b* between each rib 138. This profile acts to further stiffen the post body 130, and assist in elastic recoil of the post body 130 after being elastically bent.

Although preferred forms of the present invention have been described, it will be apparent to persons skilled in the art that modifications can be made to the preferred embodiment described above or that the invention can be embodied in other forms.

The invention claimed is:

1. A roadside post comprising:

an elongate body formed of a single sheet of spring steel, said body having a longitudinal axis, a transverse axis transverse to said longitudinal axis, a body front face and a body rear face, said body front and rear faces transversely extending generally parallel to said transverse axis, said body being elastically bendable through 90 degrees from an unbent state about said transverse axis, said body formed with a plurality of longitudinally extending ribs, each rib having an apex separated from the apex of an adjacent rib by a trough; and a surface coating applied to said body front and rear faces and respectively providing an exposed front surface and an exposed rear surface of said roadside post.

2. The roadside post of claim 1 wherein said body is elastically bendable through 90 degrees from said unbent state about said transverse axis to either side of said longitudinal axis.

3. The roadside post of claim 1 wherein said body has a Rockwell hardness of C40 to C47.

4. The roadside post of claim 3 wherein said spring steel is high carbon steel C1075.

5. The roadside post of claim 1 wherein said body has a transverse width of approximately 75 mm to 120 mm.

6. The roadside post of claim 1 wherein said sheet of spring steel has a thickness of approximately 0.9 mm to 1.5 mm.

7. The roadside post of claim 1 wherein said body has a substantially arcuate transverse cross-section.

8. The roadside post of claim 7 wherein said transverse cross-section has a radius of approximately 100 mm to 250 mm.

9. The roadside post of claim 1 wherein said body has a channel shaped transverse cross-section comprising a central web and two lateral flanges.

10. The roadside post of claim 9 wherein the angle formed between said web and each said flange is approximately 150 degrees to 175 degrees.

11. The roadside post of claim 1 wherein said post further comprises a rigid base adapted to be driven into the ground, a first end of said body being fixed to said base.

12. The roadside post of claim 11 wherein said base has a tapered end longitudinally distal of the body, said base tapered end being adapted to be driven into the ground.

13. The roadside post of claim 1 wherein a first end of said body is adapted to be driven into the ground.

14. The roadside post of claim 13 wherein said body first end is tapered.

15. The roadside post of claim 1 wherein said body includes a mark indicative of the location of the surface of the ground when said post is driven into the ground to a design depth.

16. The roadside post of claim 15 wherein said mark is a hole.

17. A roadside post installation comprising the roadside post of claim 1 in which said post is driven into the ground.

18. The roadside post installation of claim 17 wherein a recess is formed in the ground immediately adjacent said body to allow uninhibited bending of said body, said recess extending across either of said body front face and said body rear face.

19. The roadside post installation of claim 18 wherein said recess extends approximately 50 mm to 150 mm from said transverse axis at the surface of the ground.

20. The roadside post installation of claim 18 wherein said recess has a depth of approximately 50 mm to 150 mm.

21. The roadside post installation of claim 18 wherein two said recesses are formed in the ground, a first said recess extending across said body front face and a second said recess extending across said body rear face.

22. The roadside post installation of claim 18 wherein said post further comprises a rigid base adapted to be driven into the ground, a first end of said body being fixed to said base, and the entire said base is located beneath the surface of the ground.

23. The roadside post installation of claim 22 wherein a top of said base is located at a depth of approximately 50 mm to 150 mm beneath the surface of the ground.

24. The roadside post of claim 1 wherein said apexes of each adjacent pair of said ribs are laterally separated by about 5 mm to about 25 mm.

25. The roadside post of claim 24 wherein each said apex protrudes about 0.2 mm to about 0.8 mm from an adjacent said trough.

26. The roadside post of claim 13 wherein said body further comprises a barb located toward said first end of said body and projecting toward an opposing second end of said body.

27. The roadside post of claim 1 wherein said body includes a taper at a first end thereof, said taper extending outwardly from a central portion of said first end.

28. A method of installing the roadside post of claim 1, said method comprising driving said post into the ground.

29. The method of claim 28 further comprising forming at least one recess in the ground immediately adjacent said body to allow uninhibited bending of said body, said at least one recess extending across either of said body front face and said body rear face.

30. The method of claim 29 wherein said at least one recess extends approximately 50 mm to 150 mm from said transverse axis at the surface of the ground.

31. The method of claim 29 wherein said at least one recess has a depth of approximately 50 mm to 150 mm.

32. The method of claim 29 wherein two said recesses are formed in the ground, a first said recess extending across said body front face and a second said recess extending across said body rear face.

33. A roadside post comprising:

an elongate body formed of a single sheet of spring steel, said body having a longitudinal axis, a transverse axis transverse to said longitudinal axis, a body front face and a body rear face transversely extending generally parallel to said transverse axis, said body being elastically bendable through 90 degrees from an unbent state about said transverse axis, having a substantially arcuate cross-section and including a mark at a position indicative of the location of the surface of the ground when said post is driven into the ground to a design depth, and a barb located between said mark and a first end of said body and projecting toward an opposing second end of said body, said first end of said body being tapered to enable said body to be driven into the ground, and said body being formed with a plurality of longitudinally extending ribs, each of said ribs having an apex separated from the apex of an adjacent rib by a trough.

34. The roadside post of claim 33, wherein said mark is a hole.

35. The roadside post of claim 33, further comprising:

a surface coating applied to said body front and rear faces and respectively providing an exposed front surface and an exposed rear surface of said roadside post.

36. The roadside post of claim 33, wherein:

said body has a transverse width of about 75 mm to about 120 mm;

said sheet spring steel has a thickness of about 0.9 mm to about 1.5 mm;

said arcuate transverse cross-section has a radius of about 100 mm to about 250 mm; and said body is elastically bendable through 90 degrees from said unbent state about said transverse axis to either side of said longitudinal axis.

37. The roadside post of claim 33 wherein:

said apexes of said adjacent ribs are laterally spaced by about 5 mm to about 25 mm, each of said apexes protruding by about 0.2 mm to about 0.8 mm from an adjacent said trough.

* * * * *

UNITED STATES PATENT AND TRADEMARK OFFICE

CERTIFICATE OF CORRECTION

PATENT NO. : 7,585,127 B2
APPLICATION NO. : 10/561123
DATED : September 8, 2009
INVENTOR(S) : Boydan Joseph Mudryk et al.

It is certified that error appears in the above-identified patent and that said Letters Patent is hereby corrected as shown below:

Title Page

Column 1, at [86], change "October 19, 2006" to --December 15, 2005--

Signed and Sealed this
Twenty-first Day of April, 2015

Michelle K. Lee

Michelle K. Lee
*Director of the United States Patent and Trademark Office*